United States Patent [19]

Strauch et al.

[11] Patent Number: 5,062,634

[45] Date of Patent: Nov. 5, 1991

[54] SQUASH RACKET

[75] Inventors: Eric C. Strauch, Chicago; William D. Severa, Addison, both of Ill.

[73] Assignee: Wilson Sporting Goods Co., River Grove, Ill.

[21] Appl. No.: 574,581

[22] Filed: Aug. 31, 1990

[51] Int. Cl.[5] ..... A63B 49/02

[52] U.S. Cl. ..... 273/67 R; 273/73 R

[58] Field of Search ..... 273/73 R, 73 C, 73 G, 273/73 D, 73 J, 67 R

[56] References Cited

U.S. PATENT DOCUMENTS

| | | | |
|---|---|---|---|
| Re. 31,419 | 10/1983 | Frolow | 273/73 C |
| 1,122,159 | 12/1914 | Richey | 273/73 R |
| 1,539,019 | 5/1925 | Nikonow | 273/73 R |
| 2,086,275 | 7/1937 | Lemmon | 273/80 |
| 2,164,631 | 7/1939 | Abell | 273/73 C |
| 2,171,223 | 8/1939 | Robinson | 273/73 C |
| 3,647,211 | 3/1972 | Doessel et al. | 273/73 C |
| 4,165,071 | 8/1979 | Frolow | 273/73 C |
| 4,280,699 | 7/1981 | Drake | 273/73 C |
| 4,291,574 | 9/1981 | Frolow | 73/65 |
| 4,394,014 | 7/1983 | Balaban | 273/73 G |
| 4,436,305 | 3/1984 | Fernandez | 273/73 C |
| 4,441,713 | 4/1984 | Van Dyck et al. | 273/73 J |
| 4,561,655 | 12/1985 | Mortvedt | 273/73 C X |
| 4,579,343 | 4/1986 | Mortvedt | 273/73 D |
| 4,634,124 | 1/1987 | Yuhas et al. | 273/73 G |
| 4,664,380 | 5/1987 | Kuebler | 273/73 C |
| 4,690,405 | 9/1987 | Frolow | 273/73 C |
| 4,768,786 | 9/1988 | Kuebler | 273/73 C |
| 4,874,570 | 10/1989 | Haines | 264/154 |
| 4,911,444 | 3/1990 | Yoneyama | 273/73 C |

FOREIGN PATENT DOCUMENTS

| | | |
|---|---|---|
| 0171500 | 2/1986 | European Pat. Off. . |
| 317711 | 5/1989 | European Pat. Off. . |
| 381673 | 10/1932 | United Kingdom . |

OTHER PUBLICATIONS

*PROFILE The Shape of Things to Come,* 1987, Wilson Sporting Goods Co.

*Fortune, World Tennis, and Forbes Articles on the Hottest Racket,* Nov. 1988.

*Wilson PROFILE–Special Issue, World Tennis,* Jul. 1988.

*Primary Examiner*—William H. Grieb

[57] ABSTRACT

A squash racket has a frame with a head portion, a throat portion, and a shaft portion which terminates in a handle portion. The racket is lighter than prior squash rackets, and the balance point or center of gravity of the racket is closer to the head end than the handle end.

15 Claims, 2 Drawing Sheets

A
B
C
H
W
G
20
21
22
23
24
25
26
27
28
29

A
B
H
W
G
11
12
13
14
15
16
40
41
42
43

SQUASH RACKET

BACKGROUND

This invention relates to squash rackets, and, more particularly, to a squash racket which is lighter than prior squash rackets and which has a balance point or center of gravity which is closer to the head end of the racket than to the handle end.

Squash rackets conventionally have a length of about 27 inches and a weight of about 187 to 218 grams. Squash rackets are also usually "head light," i.e., the balance point or center of gravity of the racket is closer to the handle end of the racket than the head end. It is common to add lead or other weight to the handle of a squash racket in order to increase the weight of the racket, and the lead increases the "head light" characteristic of the racket.

Representative competitive squash rackets have been measured, and the physical properties of the rackets fall within the following ranges:

| Weight (Grams) | Length (Inches) | Balance (Inches) | Iend (oz. in.$^2$) |
|---|---|---|---|
| 187–218 | 26.9–27.08 | 12.04–13.73 | 1625–1909 |

"Balance" is the distance of the balance point or center of gravity from the handle end of the racket. "Iend" is the moment of inertia about an axis at the end of the handle which extends perpendicularly to the handle and is a measure of the ability of the racket to resist rotation about the axis.

Frolow Reissue U.S. Pat. No. 31,419 describes a tennis racket which is lighter than conventional tennis rackets and in which weight is removed from the handle end and added to the head end to make the racket "head heavy," i.e., the balance point or center of gravity is closer to the head end of the racket than the handle end. Frolow also describes making the racket stiffer so that the frequency of vibration of the racket described in column 13 of FIG. 40 of the patent is greater than 140 cycles per second. The Frolow patent does not describe a squash racket, which is distinctly different than a tennis racket in shape, weight, and other physical characteristics.

SUMMARY OF THE INVENTION

The invention provides a squash racket which is significantly lighter than prior squash rackets and which is "head heavy." The weight of the racket is within the range of about 150 to about 175 grams. The length of the racket is about 27 inches, and the balance point or center of gravity is about 15 to about 16.5 inches from the handle end. The moment of inertia about an axis at the end of the handle is about 1825 to 1925 Oz. In.$^2$, and the center of percussion is about 19-½ to 22-½ inches from the end of the handle. The racket preferably does not include lead or other weighting material in the handle, although a small amount of lead might be used to fine tune the weight of the racket.

DESCRIPTION OF THE DRAWING

The invention will be explained in conjunction with illustrative embodiments shown in the accompanying drawing, in which.

DESCRIPTION OF SPECIFIC EMBODIMENT

Figures 1, 2, 3, 4, 5, 6, 7, 8:
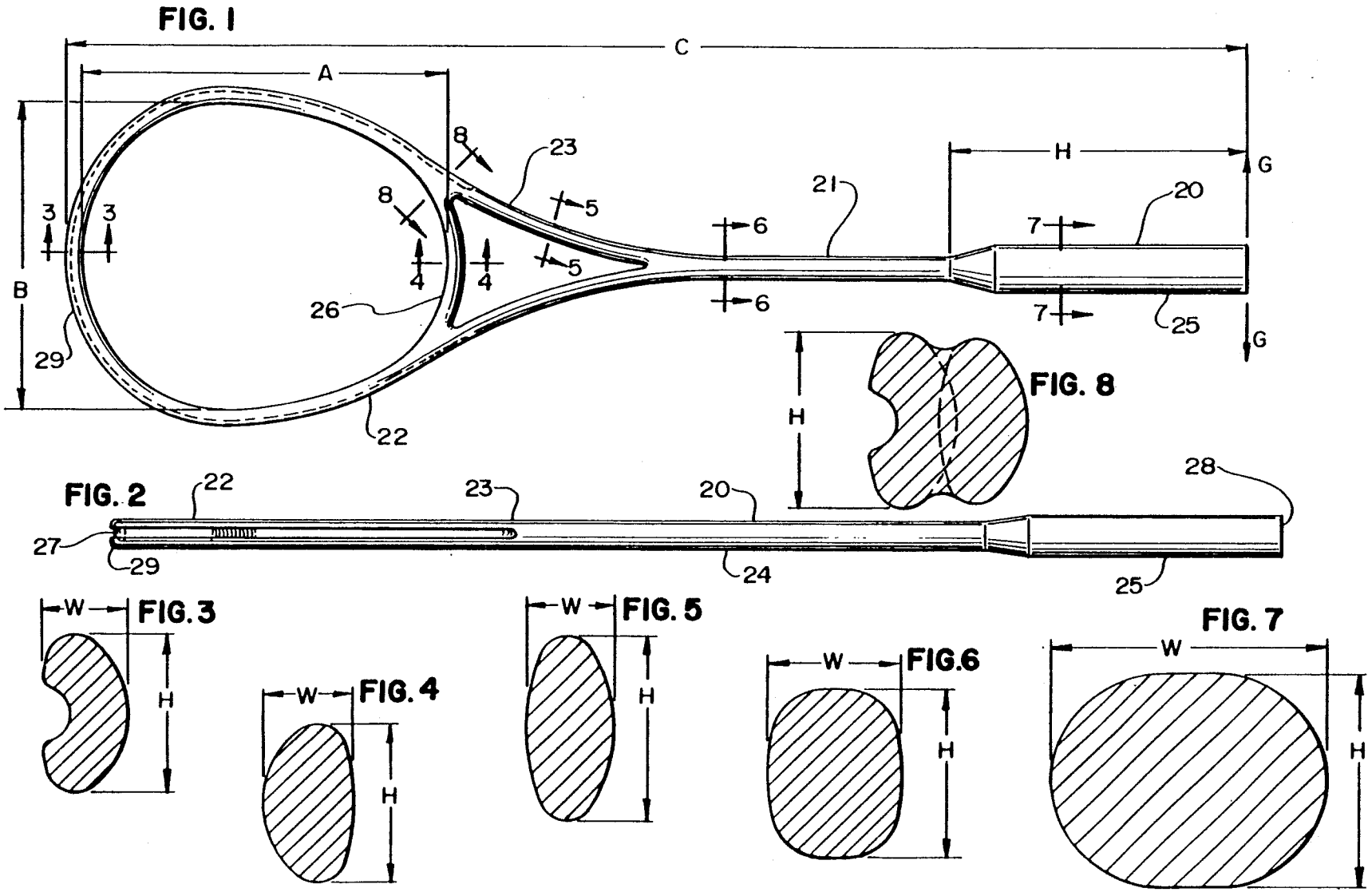
FIG. 1 is a plan view of a squash racket frame formed in accordance with the invention.
FIG. 2 is a side elevational view of the racket frame.
FIG. 3 is a sectional view taken along the line 3—3 of FIG. 1.
FIG. 4 is a sectional view taken along the line 4—4 of FIG. 1.
FIG. 5 is a sectional view taken along the line 5—5 of FIG. 1.
FIG. 6 is a sectional view taken along the line 6—6 of FIG. 1.
FIG. 7 is a sectional view taken along the line 7—7 of FIG. 1.
FIG. 8 is a sectional view taken along the line 8—8 of FIG. 1.

Referring to FIGS. 1 and 2, the numeral 20 designates a squash racket comprising a frame 21 which includes a hoop-shaped head portion 22 a generally V-shaped open throat portion 23, and an elongated shaft portion 24. The shaft portion terminates in an enlarged handle portion 25. A yoke or throat piece 26 extends between the V-shaped throat portion and forms the bottom of the hoop of the head portion.

The head portion is adapted to support conventional longitudinal and transverse strings which provide a conventional strung surface. The outer surface of the head portion 22 is provided with a groove 27 to accommodate the cross-over portions of the strings, and the head portion 22 and the yoke 26 are drilled to provide openings for the strings.

The racket is completed by a conventional butt cap (not shown) which is mounted on the butt end 28 of the handle portion and by a conventional flexible strip of leather or synthetic material (not shown) which is spirally wound around the handle portion to provide a hand grip.

The racket frame is preferably molded from graphite fibers and resin, although other materials could be used. The shape and cross section of the frame is such that the frame is lighter than conventional squash racket frames and is head heavy. The particular frame illustrated in FIGS. 1 and 2 weighs from 5.4 to 6.0 ounces (154 to 169 grams). The overall length L of the frame is 26.94 inches, and the balance point or center of gravity is 15.6 to 16.3 inches from the butt end 28 of the frame. The end moment of inertia of the frame about the axis G—G is from 1850 to 1950 ounce inch$^2$. The axis G—G extends perpendicularly to the handle portion 25 at the butt end 28.

The center of percussion of a racket is the point at which a ball striking a freely suspended racket will cause the racket to rotate about the axis G—G without moving the axis G—G. Prior squash rackets generally have a center of percussion less than 20 inches from an axis at the butt end. The racket illustrated in FIGS. 1 and 2 has its center of percussion at 20.6 inches from the butt end 28 when the center of percussion is measured with respect to the axis G—G at the butt end. When the center of percussion is measured with respect to an axis which is parallel to the axis G—G but 3 inches from the butt end, the center of percussion is 18.3 inches from that axis toward the head end 29.

As described in European Patent Office Publication No. EP 0 317 711 the frequency of vibration of a racket can be measured under "free-free" constraint or "clamped-free" constraint. Free-free constraint represents a body vibrating unconstrained in space and may be approximated in the laboratory by suspending the body by elastic bands and allowing it to vibrate freely. Clamped-free constraint represent the condition in which one end of the body is rigidly clamped in a support fixture while the other end is allowed to vibrate freely. The European Patent Office publication describes vibrational frequencies of a tennis racket under free-free constraint in the range of 170 Hz to 250 Hz for the first mode of vibration. Prior squash rackets conventionally have a first mode of vibrational frequency under free-free constraint within the range of about 100 to 130 Hz. More recently, applicants' assignee Wilson Sporting Goods Co. has marketed prior art squash rackets which have frequencies of within the range of about 160 to 190 Hz.

The racket frame illustrated in FIGS. 1 and 2 has a first mode of vibrational frequency under free-free constraint of about 150 Hz. The frame has a vibrational node in the handle portion located at 5.79 inches from the butt end 28.

The longitudinal dimension A of the strung surface, which is the inside dimension of the head portion, is 8.45 inches. The transverse dimension B of the strung surface is 7.25 inches. The length H of the handle portion 25 is 6.811 inches.

FIGS. 3–8 illustrate the height H and width W of the cross section of the frame at Sections 3—3 through 8—8, respectively. The height and width of the cross sections vary along the length of the frame. Referring to FIG. 2, the height of the side profile of the racket frame increases from the head end 29 to a maximum height at Section C—C and tapers downwardly toward the handle portion 25. The height H and width W of the cross sections are set forth in Table I.

TABLE I

| Cross Section | Height (inch) | Width (inch) |
|---|---|---|
| AA | 0.669 | 0.355 |
| BB | 0.669 | 0.367 |
| CC | 0.787 | 0.367 |
| DD | 0.717 | 0.551 |
| EE | 0.902 | 1.13 |
| FF | 0.740 | |

Figures 9, 10, 11, 12, 13, 14, 15, 16:
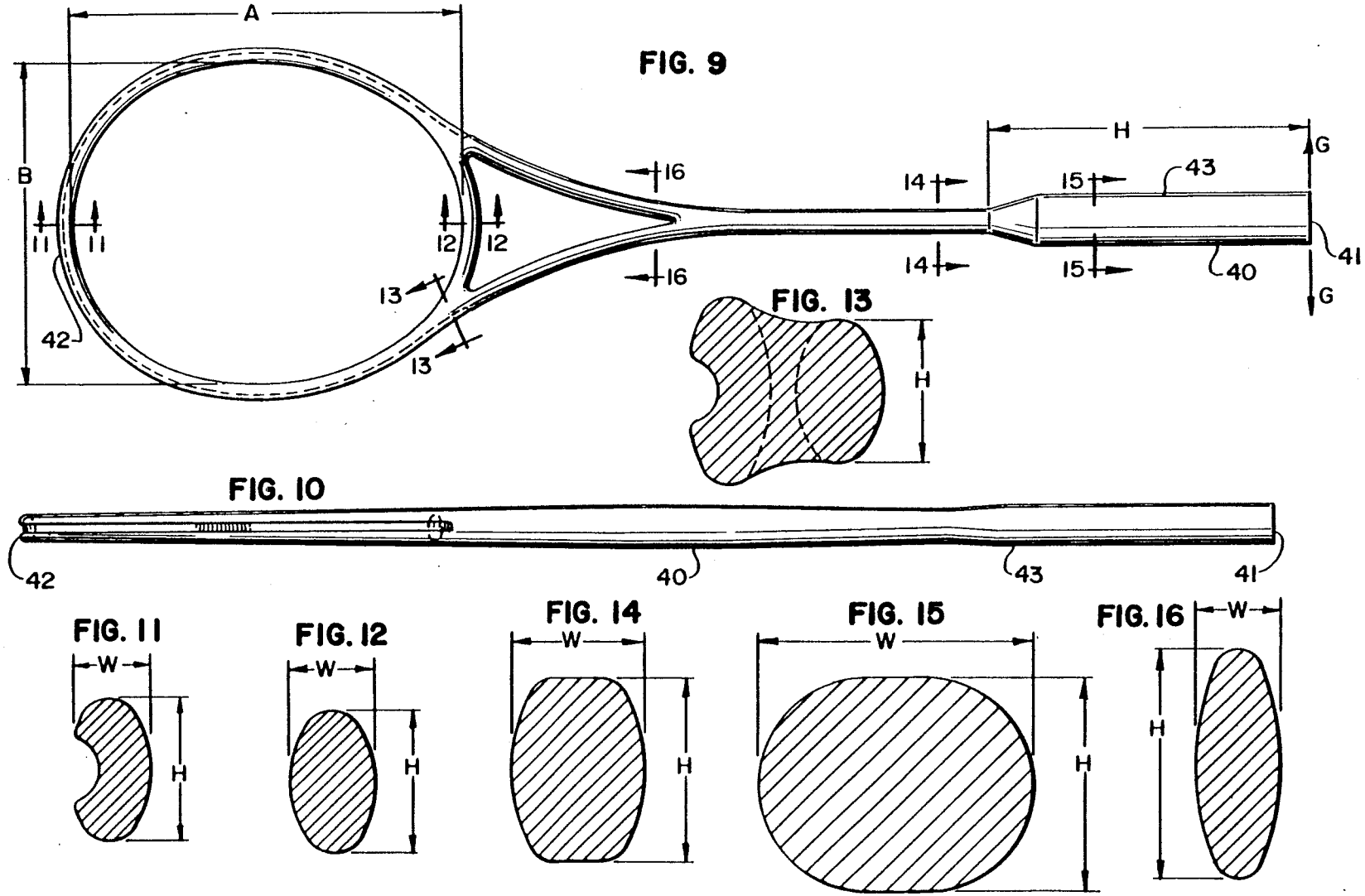
FIG. 9 is a plan view of a modified embodiment of a squash racket frame formed in accordance with the invention.
FIG. 10 is a side elevational view of the racket frame of FIG. 9.
FIG. 11 is a sectional view taken along the line 9—9 of FIG. 9.
FIG. 12 is a sectional view taken along the line 10—10 of FIG. 9.
FIG. 13 is a sectional view taken along the line 11—11 of FIG. 9.
FIG. 14 is a sectional view taken along the line 12—12 of FIG. 9.
FIG. 15 is a sectional view taken along the line 13—13 of FIG. 9.
FIG. 16 is a sectional view taken along the line 14—14 of FIG. 9.

A modified embodiment of a squash racket frame 40 is illustrated in FIGS. 9 and 10. The frame 40 is also molded from graphite fibers and resin and has an overall length L of 26.882 inches. The longitudinal and transverse dimensions A and B of the strung surface are 8.453 inches and 7.1349 inches, respectively. The weight of the frame is 5.5 to 6.0 ounces (156 to 171 grams), and the balance point is 15.3 to 16.1 inches from the butt end 41. The end moment of inertia about the axis G—G is 1825 to 1925 oz. in.$^2$. The center of percussion measured with respect to an axis G—G at the butt end 41 is 20.1 inches from the butt end, and the center of percussion measured with respect to an axis at a point 3 inches from the butt end is 18.1 inches toward the head.

The racket frame 40 has a dual taper side profile (FIGS. 9 and 10) and tapers outwardly from the head end 42 to a maximum height at Section F—F and tapers downwardly from Section F—F to the handle portion 43. The height H and width W of the cross sections illustrated in FIGS. 11–16 are set forth in Table II:

TABLE II

| Cross Section | Height (inch) | Width (inch) |
|---|---|---|
| 11-11 | 0.660 | 0.320 |
| 12-12 | 0.600 | 0.350 |
| 13-13 | 0.600 | |
| 14-14 | 0.780 | 0.550 |
| 15-15 | 0.902 | 1.134 |
| 16-16 | 0.980 | 0.350 |

The dimensions for the racket frame may vary within a range of about ±0.5 inch, and the frequency is preferably at least 140 Hz and more preferably at least 150 Hz. The center of percussion about the axis G—G may be within the range of 19-½ to 22-½ inches from the axis, and preferably within the range of 20 to 22-½ inches.

The handle portions of the racket frames 20 and 40 are formed only from graphite fibers and resin and preferably do not include any lead or other weighted material. However, a few grams of lead tape might be used to provide the racket with a desired total weight. Conventional squash rackets commonly include as much as 20 to 30 grams of lead in the handle to increase the weight of the racket.

The graphite frame can be made in the conventional manner by laying the graphite fibers and resin around an elongated inflatable bladder which is then arranged in the shape of the frame. The resin is cured under heat and pressure, and the bladder is then deflated and removed to provide a hollow frame.

While in the foregoing specification detailed descriptions of specific embodiments of the invention were set forth for the purpose of illustration, it will be understood that many of the details herein given may be varied considerably by those skilled in the art without departing from the spirit and scope of the invention.

We claim:

1. A squash racket comprising a frame having a head portion adapted to support a strung surface, a handle portion adapted to be held by a player, a shaft portion connected to the handle portion, and a throat portion connecting the handle portion and the head portion, the improvement characterized by the racket having:

a) a weight within the range of about 150 to about 175 grams, and b) a center of gravity located closer to the head end of the racket than the handle end of the racket.

2. The squash racket of claim 1 in which the length of the frame is about 27 inches and the center of gravity of the racket is about 15 to about 16.5 inches from the handle end of the racket.

3. The squash racket of claim 1 in which the vibrational frequency of the racket in the first mode of free-free constraint is at least about 150 Hz.

4. The squash racket of claim 1 in which the center of percussion measured from the handle end is about 19-½ to 22-½ inches from the handle end.

5. The squash racket of claim 1 in which the center of percussion measured from the handle end is about 20 to 22-½ inches from the handle end.

6. The squash racket of claim 1 in which the racket is formed from graphite fibers and resin and the handle portion does not include lead.

7. A squash racket comprising a frame having a head portion adapted to support a strung surface, a handle portion adapted to be held by a player, a shaft portion connected to the handle portion, and a throat portion connecting the handle portion and the head portion, the overall length of the frame being about 27 inches, the improvement characterized by the racket having:

a) a weight within the range of about 150 to 175 grams, b) a center of gravity located about 15 to about 16.5 inches from the handle onto the racket;

c) a center of percussion measured from the handle end of about 19-½ to 22-½ inches from the handle end;

d) a moment of inertia about an axis at the handle end which extends perpendicularly to the handle of about 1825 to about 1950 oz. in.$^2$, and e) a vibrational frequency in the first mode of free-free constraint of at least about 140 Hz.

8. The squash racket of claim 7 in which the vibrational frequency of the racket is at least about 150 Hz.

9. The squash racket of claim 7 in which the center of percussion measured from the handle end is about 20 to 22-½ inches from the handle end.

10. A squash racket comprising a frame having a head portion adapted to support a strung surface, a handle portion adapted to be held by a player, a shaft portion connected to the handle portion, and a throat portion connecting the handle portion and the head portion, the improvement characterized by the racket having:

a) a weight within the range of about 150 to about 175 grams, b) a center of gravity located closer to the head end of the racket than the handle end of the racket, and c) a vibrational frequency in the first mode of free-free constraint of at least about 140 Hz.

11. The squash racket of claim 10 in which the center of percussion measured from the handle end is about 19-½ to 22-½ inches from the handle end.

12. A squash racket comprising a frame having a head portion adapted to support a strung surface, a handle portion adapted to be held by a player, a shaft portion connected to the handle portion, and a throat portion connecting the handle portion and the head portion, the improvement characterized by the racket having:

a) a weight within the range of about 150 to about 175 grams, b) a center of gravity located closer to the head end of the racket than the handle end of the racket, and c) a moment of inertia about an axis at the handle end which extends perpendicularly to the handle is about 1825 to about 1950 oz. in.$^2$.

13. The squash racket of claim 12 in which the center of percussion measured from the handle end is about 19-½ to 22-½ inches from the handle end.

14. A squash racket comprising a frame having a head portion adapted to support a strung surface, a handle portion adapted to be held by a player, a shaft portion connected to the handle portion, and a throat portion connecting the handle portion and the head portion, the head portion adapted to provide a strung surface having a longitudinal dimension parallel to the shaft portion of less than 9 inches and a transverse dimension perpendicular to the shaft portion of less than 8 inches, the improvement characterized by a racket having:

a) a weight within the range of about 150 to about 175 grams, and b) a center of gravity located closer to the head end of the racket than the handle end of the racket.

15. The squash racket of claim 14 in which the length of the frame is about 27 inches and the center of gravity of the racket is about 15 to about 16.5 inches from the handle end of the racket.

* * * * *